175-48
4/7/87 XR 4,655,289

United States Patent [19]

Schoeffler

[11] Patent Number: 4,655,289

[45] Date of Patent: Apr. 7, 1987

[54] REMOTE CONTROL SELECTOR VALVE

[75] Inventor: William N. Schoeffler, Lafayette, La.

[73] Assignee: Petro-Design, Inc., Youngsville, La.

[21] Appl. No.: 784,262

[22] Filed: Oct. 4, 1985

[51] Int. Cl.[4] ..... E21B 34/10

[52] U.S. Cl. ..... 166/320; 175/38; 175/48; 137/498

[58] Field of Search ..... 175/24, 25, 28, 48, 175/215, 232, 234, 243, 317, 318; 166/319, 320, 321, 325, 330, 157, 158, 172; 137/498, 517

[56] References Cited

U.S. PATENT DOCUMENTS 1,630,666 5/1927 McEvoy, Jr. ..... 166/158

3,764,969 10/1973 Cubberly, Jr. ..... 175/232 X 3,967,680 7/1976 Jeter ..... 175/48 X 4,470,464 9/1984 Baldenko et al. ..... 166/325

*Primary Examiner*—Stephen J. Novosad

*Assistant Examiner*—David J. Bagnell

*Attorney, Agent, or Firm*—John D. Jeter

[57] ABSTRACT

A control system for use on fluid conducting pipe strings in earth boreholes to permit cycling of fluid flow between preselected flow rates to change conditions downhole as a result of surface exercise of fluid flow controls. A resulting change of state downhole is indicated by a change in fluid flow related pressure detectable at the surface.

9 Claims, 2 Drawing Figures

REMOTE CONTROL SELECTOR VALVE

This invention pertains to apparatus to cause preselected response by equipment in earth boreholes in response to actions taken at the earth surface. More particularly, apparatus of the invention is used on fluid conducting pipe strings in earth boreholes to achieve downlink command and optionally to indicate downhole, by signals detectable at the earth surface, that the command has been received.

PRIOR ART

The following U.S. patents are cited as being germane to this application.

U.S. Pat. No. 2,415,249, February, 1947; U.S. Pat. No. 3,324,717, June, 1967;

U.S. Pat. No. 2,681,567, June, 1954; U.S. Pat. No. 3,780,809, December, 1973;

U.S. Pat. No. 2,924,432, February, 1960; U.S. Pat. No. 3,800,277, March, 1974;

U.S. Pat. No. 3,039,543, June, 1962; U.S. Pat. No. 3,896,667, July, 1975;

U.S. Pat. No. 3,051,246, August, 1962; U.S. Pat. No. 3,967,680, July, 1946.

BACKGROUND

Various methods have been used to control devices downhole primarily on drill strings to cause an action to be carried out as a result of an initiating action at the earth surface, usually at the rig floor. Balls dropped down the drill string bore were used to cause an action, usually not reversible until the drill string was removed from the borehole to recover the dropped ball and reset the influenced device.

Spears were dropped down the well bore to cause a bend to take place in the drillstring. The spear could be adapted to be recovered by wire line run down the drill string bore. This was quite effective and was a reversible action, but time was invested in the wire line trip. This reduced the frequency with which the drilling crews were willing to exercise the controlled device.

As mud pulse communication came into common use for measurement while drilling, the term downlink command came into common use to describe any form of communication initiated at the earth surface to cause a preferred action to take place downhole. The U.S. Pat. No. 3,967,680 was issued July 6, 1976, to cause actions downhole as a result of selecting first to rotate the drill string, then start fluid flow to cause one action. The procedure was reversed to cause an alternate action to take place. After the first selected procedure activated the downhole selector, the pipe could be repeatedly started and stopped to select additional choices of action.

U.S. Pat. No. 3,896,667 was issued July 29, 1975, to control downhole devices by action of the fluid flow alone. To execute a downlink command, an intermediate fluid flow was selected, lower than the flow needed for drilling, and the flow rate was held until a timer ran a specific period before the elected action would take place. Many choices could be exercised. A different flow rate, held for a selected length of time, could cancel encoded actions and return to normal drilling configuration. This device generated a pulse signal to indicate the downlink command had been received and acted upon.

It is desirable to have a responsie device downhole that will change state each time the fluid flow down the string is initiated. If an action is not needed but is responsive to the onset of fluid flow, the flow can be stopped and restarted to select the alternate state downhole. One such apparatus to be controlled is the apparatus of my copending patent application 784,261. Feedback information is needed to assure that there is no risk of confusion as to which state is activated.

Apparatus of this invention has recently been used in downhole drilling related activities to actuate the apparatus of my copending application No. 784,261.

OBJECTS

It is therefore an object of this invention to provide apparatus downhole which offers a choice of options by the expedient of simply reducing fluid flow below a selected level and increasing the flow to an operational level.

It is yet another object of this invention to provide apparatus downhole that will provide different flow resistances to fluid flow for the options being exercised downhole, so that the state existing downhole can be determined by pressure differences observable at the surface.

It is still another object of this invention to provide apparatus that will require no electrical power sources downhole to carry out the downlink command function.

It is yet another object of this invention to carry out downlink command functions without requiring drill string rotation or flow meters for controlling and activating the response to fluid flow cycling.

These and other objects, advantages, and features of this invention will be apparent to those skilled in the art from a consideration of this specification, including the attached drawings and appended claims.

BRIEF DESCRIPTION OF THE DRAWINGS

In the drawings, wherein like reference characters are used throughout to designate like parts.

DETAILED DESCRIPTION OF DRAWINGS

Figure 1:
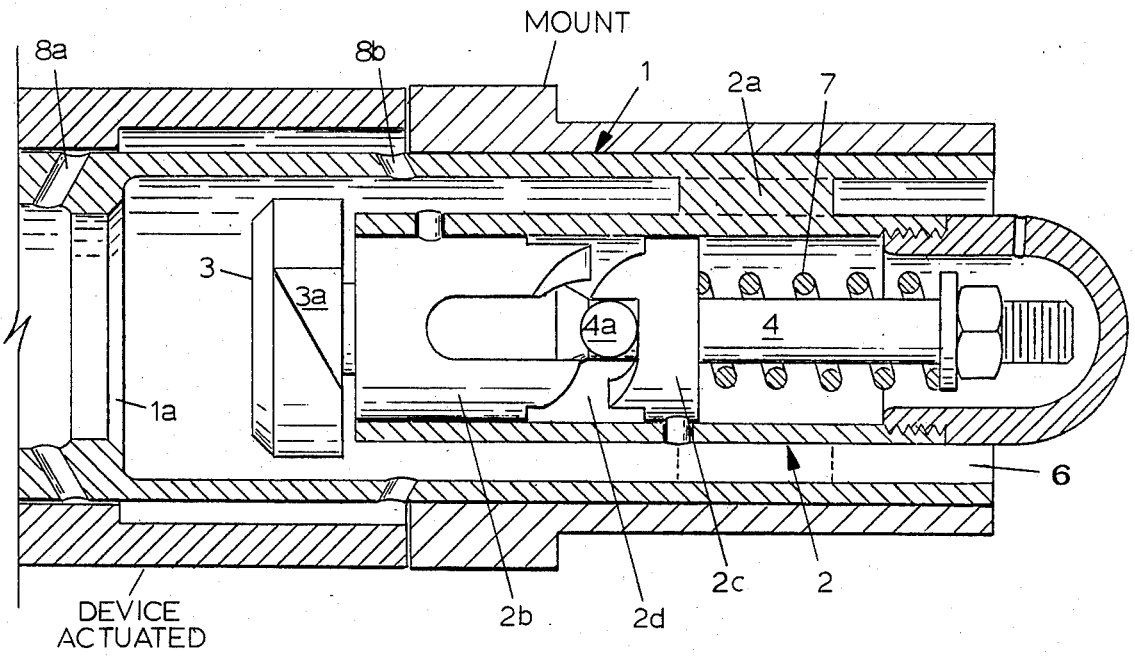
FIG. 1 is a plan view, partially cutaway, of the apparatus of this invention.

In FIG. 1 the apparatus of this invention is shown in a mount for centering in a sealed and supported situation in a pipe string component such that fluid flowing down the pipe string will at least partly be compelled to flow through the apparatus. The action to be carried out as a result of selective actuation of the apparatus is forceful movement of the actuated device which will be attached to or be part of the pipe string. Sealing and confining structure for the piston is omitted to emphasize the points of novelty.

Body 1 is secured in the pipe string bore (not shown) with orifice 1*a* at the downstream end. Housing 2 is secured in the body generally concentric with the axis of channel 6, secured by spiders 2*a*, and also has a cylindrical co-axial bore. Cams 2*b* and 2*c* are secured by pins in the housing bore as shown, so contoured and spaced apart as to cooperate to form serpentine groove 2*d*. The cams have a concentric bore to serve as support bearings for valve control rod 4.

Control rod 4 extends into and is fastened to poppet 3. Crosshead pin 4*a* is transverse, extends equally from both sides of but is part of control rod 4. Pin 4*a* is confined within groove 2*d*. For reasons explained later, pin 4*a* will be free to move peripherally around the confines of the groove, and in this case, there will be four possible locations for one pin, permitting at least some axial excursions of the pin in the groove. These four positions are about ninety degrees apart. As will be shown, the groove at alternate possible axial movement locations will extend far enough axially for poppet 3 to move into cooperation with orifice 1*a* to inhibit fluid flow through the orifice. The other cam locations permitting axial excursions of the pin stop before allowing the poppet to reach the orifice.

Spring 7 exerts a force between the housing and control rod and tends to move the rod and poppet to the right or upstream. Fluid moving left through channel 6 tends to entrain the poppet and move it left. This pulls rod 4 to the left. A surface 3*a* is milled into the poppet periphery and has a turbine surface exposed to the fluid stream. Viewed from the left, this tends to rotate poppet, rod 4, and pin 4*a* clockwise and move all toward the orifice.

Starting with no fluid flow, the poppet and pin 4*a* will be positioned as shown. As fluid flow moving left in channel 6 increases, the poppet will overcome spring bias and move left, and rotate clockwise as described, moving pin 4*a* along the helical path of groove 2*d*. The helical portion of the groove terminates at an axial groove, and as flow increases the pin will move as far axially as the groove permits. On alternate axial excursions, the poppet is allowed to proceed into cooperation with the orifice, which may or may not be closure, but will cause increased flow resistance. Fluid will be encouraged to flow through an alternate channel and is the effect to be accomplished.

When fluid flow is sufficiently reduced, spring 7 will begin retraction of rod 4 into the housing, and pin 4*a* will move to the right along the axial travel permitted by groove 2*d*. The poppet will still be urged clockwise, as described, and the pin will not re-enter the first helical path intersection, and will proceed to the upper limit of travel. With spring force still urging the rod to the right, the pin will not be able to enter the second helical path encountered by the pin. Restart of fluid flow will repeat the process described above, but the next axial excursion permitted by groove 2*d* and pin 4*a* will stop the poppet before it reaches the previous permitted travel limt.

The effect of the action so far described will be to resist the flow of fluid through the orifice. Available alternate paths for fluid flow include duct 8*b*. This will make the available fluid pressure act on an annular piston of the actuated device. The actuated device, in this case, has the configuration of the apparatus of my co-pending application 784,261. The piston will move left and open duct 8*a*. Fluid then returns to the bore of the pipe string component. Ducts 8*a* and 8*b* are so sized that fluid flow through them will have a greater resistance than that existing in the open orifice. The resulting pressure increase will be an uplink acquisition signal detectable at the surface to indicate which state exists downhole.

Movement of the actuated device and the concomitant pressure change detectable at the earth surface represents achieved ends as illustrated only. The 8*a* and 8*b* duct can simply operate pressure switches or flow responsive devices to achieve a communication end. An actuated switch and concomitant pressure change constitutes a downlink command and uplink communication of action achieved.

Figure 2:
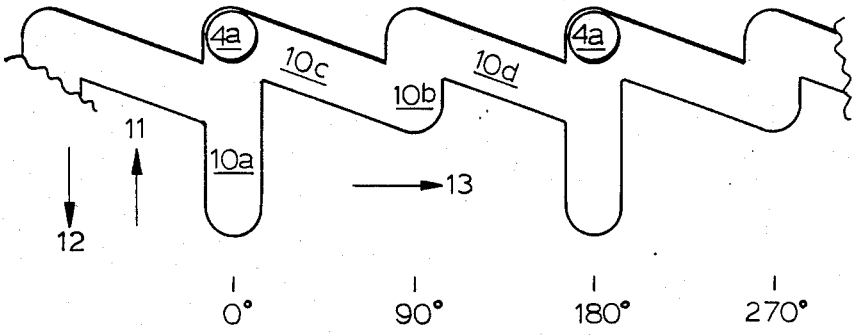
FIG. 2 is a development of inside cylindrical surfaces of a principal part of this invention.

FIG. 2 represents a development of the groove 2*d* as viewed radially toward the centerline of valve control rod 4.

Crosshead pin 4*a* is in the position shown in FIG. 1. Arrow 11 shows spring bias. Arrow 12 shows the direction of flow induced force on poppet 3. Arrow 13 shows the direction of pin travel urged by fluid flow induced tendency of rotation of poppet 3. Note that there are two crosshead pins 4*a* at 180 degrees apart.

Groove 10*a* shows the axial portion of groove 2*d* that allows the poppet to approach the orifice. Axial groove 10*b* is the alternate groove that prevents poppet and orifice cooperation. Helical groove 10*c* conducts a crosshead from a poppet closed cycle to a poppet open cycle, and groove 10*d* does the opposite.

Stated otherwise, in response to fluid flow down the pipe string and through channel 6, poppet 3 will respond as a flow sensor to produce an output signal by moving downstream. When fluid flow is again increased from a preselected flow rate to a higher flow rate crosshead pin 4*a*, in conjunction with serpentine groove 2*d*, will operate to function as means to change the signal characteristics in response to the number of times the output signal is produced. The signal characteristic, in this embodiment, is the amount of distance poppet 3 can move in response to fluid flow. On alternate instances of flow increase, beyond a preselected amount, poppet 3 will move down to inhibit flow through orifice 1*a*. Poppet 3 and orifice 1*a* comprise an actuator means responsive to a signal characteristic of extended downstream movement of the poppet. A pressure differential across the poppet and orifice is available to operate downhole machine elements. To signal characteristics of short poppet travel, no pressure differential will be produced and the poppet and orifice, as a flow restrictor, will not respond.

Obviously, any number of pins and grooves may be used. The grooves in alternate positions do not have to be set up for reversal of state, since there may be occasion, for instance, to have several consecutive cycles of flow rate change permit unchanged state. This is anticipated and is within the scope of the claims.

From the foregoing, it will be seen that this invention is one well adapted to attain all of the ends and objects hereinabove set forth, together with advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, what is claimed is:

1. In earth borehole operations involving fluid conducting pipe strings in which operators at the earth surface control downhole machinery by actions at the earth surface involving fluid flow rate manipulation, apparatus comprising:

a. a pipe string suspended in an earth borehole;

b. means situated at the earth surface to cause fluid flow and to control the rate of fluid flow through said pipe string;

c. means situated downhole attached to said pipe string responsive to said fluid flow rate to produce an output signal when said flow is caused to exceed a preselected rate;

d. downhole means responsive to said signal to produce a preselected change in the characteristic of said signal in response to a preselected number of times said signal is produced; and e. actuator means responsive to at least one characteristic of said signal to actuate preselected downhole machine elements attached to said pipe string, said actuator means being non-responsive to at least one other characteristic of said signal.

2. The apparatus of claim 1 in which said actuator means is responsive to at least one characteristic of said signal to actuate a valve which restricts said flow of fluid in said pipe string to yield a pressure differential across said valve to operate at least one downhole machine element.

3. A control valve for use downhole with fluid conducting pipe strings in earth boreholes, controllable by manipulation of the rate of fluid flow through the pipe string, to make fluid power selectively available from the pipe string to carry out selected downhole actions, apparatus comprising:

a. a body secured in the pipe bore having an upstream end and a downstream end, and a generally axial channel extending therethrough;

b. a housing mounted in said channel with a bore having a longitudinal axis generally parallel with the pipe centerline;

c. a valve control rod situated in said housing extending along said axis and out a downstream end, mounted in said housing for rotational and axial movement;

d. a valve poppet mounted on the exposed end of said control rod, the poppet diameter such as to leave some flow space between the poppet major diameter and said channel bore;

e. a valve orifice mounted in said channel in fluid tight engagement therewith, so situated that said poppet can, with available axial travel of said control rod, cooperate with said orifice to resist fluid flow therethrough;

f. a crosshead on said control rod with at least one projection extending some distance radially outward;

g. surfaces inside said housing bore forming a continuous peripheral serpentine groove opening radially inward, sized to accept said projection and generally describing alternate helical and axial directions, at least one of said axial directions extending far enough to allow said poppet to cooperate with said orifice, at least one of said axial groove directions extending a lesser axial distance;

h. at least one surface on said poppet so contoured that fluid flowing in said channel will tend to move said poppet downstream and to move said crosshead pin in the helical direction of said groove and to the limit of any axial travel beyond the limits of said helical portion of said groove;

i. a spring situated around said valve control rod so mounted as to apply an upstream force between said housing and said rod, said spring selected to provide such force that a first flow rate will not move said poppet downstream, and a larger second selected flow rate will move said poppet into said orifice when constraints permit; and j. a fluid duct in communication with said channel upstream of said orifice, extending to at least one device to be actuated by the fluid power available in the pipe bore, when said poppet and said orifice cooperate to resist the flow of fluid through said channel.

4. The apparatus of claim 3 further provided with at least one piston and cylinder arrangement, in hydraulic communication with said channel, and biased such as to move in a first direction when said orifice is not approached by said poppet, and to move in a second direction when said orifice and said poppet are positioned to resist flow through said orifice, further provided with means on said piston to transmit force and motion to at least one cooperating controlled device.

5. The apparatus of claim 3 further provided with a cooperating pipe string and at least one downhole machine element having an active state and an inactive state, one state comprising a useful function, said change of state comprising the consequence of at least one orifice and poppet relative position.

6. The apparatus of claim 3 further provided with a bypass flow route to conduct said fluid around said orifice so sized as to cause an increase in pressure across said orifice when said poppet restricts fluid flow through said orifice, and a hydraulic communication duct from said channel upstream of said orifice to a controlled device responsive to said increase in pressure.

7. The apparatus of claim 3 further provided with valve means, responsive to actuation of a controlled device, to close said duct until said controlled device is actuated.

8. Apparatus for use downhole on fluid conducting pipe strings used in earth bore holes to control downhole machinery in response to the manipulation, at the earth surface, of the rate of flow of fluid pumped down the pipe string bore, the apparatus comprising:

a. body situated in the pipe string;

b. a fluid flow sensor means situated in said body responsive to the flow of fluid in the pipe string to produce an output signal when the fluid flow exceeds a preselected amount;

c. signal characteristic change means, situated in said body, responsive to said output signal, to change the characteristics of said output signal in response to a preselected number of times said signal in produced; and d. actuator means, situated in said body, responsive to at least one characteristic of said output signal to actuate at least one downhole machine element attached to said pipe string, said actuator means being non-responsive to at least one different signal characteristic.

9. The apparatus of claim 8 further providing that said output signal be the movement of at least one valve element toward closure of said valve, said valve, further, being operatively associated with the fluid stream moving in the pipe string, further providing that said signal characteristic change include the amount of movement of said valve element toward closure.

* * * * *